US012674617B2

(12) United States Patent
Jung et al.

(10) Patent No.: US 12,674,617 B2
(45) Date of Patent: Jul. 7, 2026

(54) REFRIGERATOR

(71) Applicant: Samsung Electronics Co., Ltd., Suwon-si (KR)

(72) Inventors: Taeyun Jung, Suwon-si (KR); Yonghyun Kang, Suwon-si (KR); Donghwa Kim, Suwon-si (KR); Jungkeun Park, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 216 days.

(21) Appl. No.: 18/422,688

(22) Filed: Jan. 25, 2024

(65) Prior Publication Data

US 2024/0159457 A1 May 16, 2024

Related U.S. Application Data

(63) Continuation of application No. PCT/KR2022/012161, filed on Aug. 16, 2022.

(30) Foreign Application Priority Data

Sep. 10, 2021 (KR) ..... 10-2021-0121301

(51) Int. Cl.
*F25D 23/06* (2006.01)

(52) U.S. Cl.
CPC ..... *F25D 23/065* (2013.01)

(58) Field of Classification Search
CPC ... F25D 23/065; F25D 23/066; F25D 2400/40
See application file for complete search history.

(56) References Cited

U.S. PATENT DOCUMENTS 4,180,297 A * 12/1979 Abrams ..... F25D 23/065 16/2.2
4,416,503 A 11/1983 Hayes
5,248,196 A * 9/1993 Lynn ..... H01R 13/743 312/406
5,941,619 A * 8/1999 Stieben ..... F25D 23/028 312/405

(Continued)

FOREIGN PATENT DOCUMENTS

DE 29606772 U1 8/1996
EP 0591667 B1 11/1997

(Continued)

OTHER PUBLICATIONS

International Search Report and Written Opinion of the International Searching Authority dated Dec. 2, 2023, in connection with International Application No. PCT/KR2022/012161, 10 pages.

(Continued)

*Primary Examiner* — Daniel J Rohrhoff

(57) ABSTRACT

Disclosed herein is a refrigerator including an inner case forming a storage compartment and including a mount with a connecting protrusion in which a connection hole is formed, an outer case coupled to an outside of the inner case, an insulation provided between the inner case and the outer case, an electrical component attached to the mount, a wire electrically connected to the electrical component through the connection hole, and a wire guide fitted into the connection hole to guide the wire.

19 Claims, 9 Drawing Sheets

(56) References Cited

U.S. PATENT DOCUMENTS

| | | | | |
|---|---|---|---|---|
| 8,845,135 | B2 | 9/2014 | Yoshida | |
| 11,022,365 | B2 | 6/2021 | Heo | |
| 11,175,089 | B2 * | 11/2021 | Marinello | F25D 23/061 |
| 11,732,956 | B2 | 8/2023 | Wei et al. | |
| 2006/0223351 | A1 * | 10/2006 | Kim | H01R 13/743 439/157 |
| 2008/0113529 | A1 * | 5/2008 | Kim | F25D 29/005 439/76.1 |
| 2011/0234074 | A1 * | 9/2011 | Dolinsek | H02G 3/04 62/340 |
| 2013/0252484 | A1 | 9/2013 | Mochizuki | |
| 2015/0194749 | A1 * | 7/2015 | Kim | F25D 23/00 439/655 |
| 2016/0123055 | A1 * | 5/2016 | Ueyama | F25D 23/028 312/405 |
| 2018/0149413 | A1 * | 5/2018 | Cakirca | F25D 23/028 |
| 2019/0017679 | A1 * | 1/2019 | Choi | F21V 7/06 |
| 2020/0149800 | A1 | 5/2020 | Kim et al. | |
| 2021/0092865 | A1 * | 3/2021 | Gentile | H05K 7/20 |
| 2022/0333847 | A1 * | 10/2022 | Yoo | F25D 23/006 |
| 2024/0060708 | A1 * | 2/2024 | Lee | E05D 3/02 |
| 2025/0079760 | A1 * | 3/2025 | Lee | F24C 7/085 |

FOREIGN PATENT DOCUMENTS

| | | | |
|---|---|---|---|
| JP | 3777979 | B2 | 5/2006 |
| JP | 5336263 | B2 | 11/2013 |
| KR | 20-0125480 | Y1 | 6/1998 |
| KR | 10-1999-0013171 | A | 2/1999 |
| KR | 20-1999-0041303 | U | 12/1999 |
| KR | 10-0334030 | B1 | 4/2002 |
| KR | 20-0318309 | Y1 | 6/2003 |
| KR | 10-2004-0025464 | A | 3/2004 |
| KR | 10-2004-0025466 | A | 3/2004 |
| KR | 10-2006-0000215 | A | 1/2006 |
| KR | 20-0436665 | Y1 | 9/2007 |
| KR | 10-2008-0051577 | A | 6/2008 |
| KR | 10-0836054 | B1 | 6/2008 |
| KR | 10-0914489 | B1 | 8/2009 |
| KR | 10-1238770 | B1 | 3/2013 |
| KR | 10-1388296 | B1 | 4/2014 |
| KR | 10-1421397 | B1 | 7/2014 |
| KR | 10-2016-0073152 | A | 6/2016 |
| KR | 10-2019-0135675 | A | 12/2019 |
| KR | 10-2218304 | B1 | 2/2021 |

OTHER PUBLICATIONS

Supplementary European Search Report dated Sep. 19, 2024, in connection with European Application No. 22867577.3, 7 pages.

* cited by examiner

REFRIGERATOR

CROSS-REFERENCE TO RELATED APPLICATIONS

This application is a Bypass Continuation of International Application No. PCT/KR2022/012161, filed Aug. 16, 2022, which claims priority to Korean Patent Application No. 10-2021-0121301, filed Sep. 10, 2021, the disclosures of which are herein incorporated by reference in their entirety.

BACKGROUND

1. Field

The disclosure relates to a refrigerator, and more particularly, to a refrigerator in which an inner case is formed by assembling a plurality of plates formed by injection molding.

2. Description of Related Art

In general, refrigerators are appliances that keep food fresh by having a main body with a storage compartment and a cold air supply device that supplies cold air to the storage compartment. The storage compartment includes a refrigerating compartment in which food is kept refrigerated at a temperature of approximately 0° C. to 5° C., and a freezing compartment in which food is kept frozen at a temperature of approximately 0° C. to −30° C.

The main body of a refrigerator is provided by combining an inner case and an outer case. The inner case forms the storage compartment, and the outer case forms the exterior of the refrigerator. An insulating material is disposed between the inner and outer cases to insulate the storage compartment.

The inner case of a refrigerator is typically formed by a vacuum forming method in which a sheet of resin material is heated, the heated sheet is placed on a mold, and air is drawn in from the opposite side of the mold so that the heated sheet is stretched across the mold or drawn into the interior of the mold by the drawing force. The vacuum forming method is not easy to achieve a structure for attaching various parts to the inner case, and is also subject to limitations on the material, thickness, and strength of the inner case.

SUMMARY

The present disclosure is directed to providing a refrigerator including an inner case formed by assembling a plurality of plates formed by injection molding.

Further, the present disclosure is directed to providing a refrigerator capable of reducing cost by having a simplified structure for fixing a wire and improving reliability by preventing leakage of foaming liquid at a wire fixing site.

Further, the present disclosure is directed to providing a refrigerator having a wire guide that has a simple structure and may be easily assembled into an inner case.

According to an embodiment of the disclosure, a refrigerator includes an inner case forming a storage compartment and including a mount with a connecting protrusion in which a connection hole is formed, an outer case coupled to an outside of the inner case, an insulation provided between the inner case and the outer case, an electrical component attached to the mount, a wire electrically connected to the electrical component through the connection hole, and a wire guide fitted into the connection hole to guide the wire.

The mount may include an accommodation space to accommodate the electrical component, and the refrigerator may include a first connector coupled to an end of the wire and a second connector electrically connected to the electrical component, wherein the first connector may be electrically connectable to the second connector in the accommodation space.

The wire guide may include an insertion portion formed on a leading section of the wire guide and inserted into the connection hole, a handle portion formed on a trailing section of the wire guide, and a stopper portion formed between the insertion portion and the handle portion.

The insertion portion may be formed such that a horizontal thickness and a vertical thickness thereof progressively increase from a front end to a rear end of the insertion portion.

The connection hole may be formed such that a horizontal thickness and a vertical thickness thereof progressively decrease from an entry to an exit of the connection hole.

The insertion portion may include a plurality of leak-proof grooves formed on an outer surface of the insertion portion to prevent foaming liquid of the insulation from entering through the connection hole.

The insertion portion may include an anti-separation protrusion protruding from an outer surface of the insertion portion to prevent the wire guide from being separated from the connection hole after the wire guide is coupled to the connection hole.

The wire guide may include a wire passage formed in the wire guide to allow the wire to pass through, and a pressing protrusion pressing the wire to allow the wire to be fixed to the wire passage.

The wire passage may be bendable so that the wire is fixed to the wire passage.

The wire guide may be deformable between an unfolded state and a folded state.

The wire guide may include a first part, a second part, and a hinge portion connecting the first part and the second part, and being a center of unfolding and folding motion of the first part and the second part.

The first part may include a first coupling, the second part may include a second coupling, and the first coupling and the second coupling may be coupled to prevent the wire guide from unfolding when the wire guide is in the folded state.

The wire passage may be formed to be recessed in one surface of the second part, and the first part may include a cover portion formed to cover the wire passage when the wire guide is in the folded state.

The pressing protrusion may protrude from the cover portion.

The hinge portion may connect one side of the first part and one side of the second part facing the one side of the first part, and the wire guide may include a wire holding hole formed between the other side of the first part and the other side of the second part to hold the wire in the wire passage.

According to another embodiment of the disclosure, a refrigerator includes an inner case forming a storage compartment, an outer case coupled to an outside of the inner case, an insulation provided between the inner case and the outer case, an electrical component attached to the interior of the inner case, a wire electrically connected to the electrical component through a connection hole formed in the inner case, and a wire guide fixing the wire and connecting the connection hole to seal the connection hole, wherein the wire guide includes a first part, a second part, and a hinge portion connecting the first part and the second part, and being a center of unfolding and folding motion of the first part and the second part, the wire guide being deformable between an unfolded state and a folded state.

The second part may include the wire passage formed to be recessed to allow the wire to pass through, and the wire may be mounted on the wire passage in the unfolded state.

The wire guide may be changed from the unfolded state to the folded state when the wire is mounted in the wire passage.

The first part may include a pressing protrusion to press the wire so that the wire mounted in the wire passage is fixed when the wire guide is in the folded state.

The first part may include the first coupling, and the second part includes the second coupling, and the first coupling and the first coupling may be coupled to prevent the wire guide from unfolding when the wire guide has been in the folded state.

According to various embodiments of the present disclosure, the inner case of the refrigerator may be formed by assembling the plurality of plates formed by injection molding.

Further, according to various embodiments of the present disclosure, the refrigerator may reduce manufacturing costs by having a simplified structure for guiding a wire and improve reliability by preventing leakage of foaming liquid at a wire fixing site.

Further, according to various embodiments of the present disclosure, the process of assembling the wire guide for guiding a wire to the inner case may be facilitated, thereby improving the assemblability of a product.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, such a device may be implemented in hardware, firmware or software, or some combination of at least two of the same. It should be noted that the functionality associated with any particular controller may be centralized or distributed, whether locally or remotely.

Moreover, various functions described below can be implemented or supported by one or more computer programs, each of which is formed from computer readable program code and embodied in a computer readable medium. The terms "application" and "program" refer to one or more computer programs, software components, sets of instructions, procedures, functions, objects, classes, instances, related data, or a portion thereof adapted for implementation in a suitable computer readable program code. The phrase "computer readable program code" includes any type of computer code, including source code, object code, and executable code. The phrase "computer readable medium" includes any type of medium capable of being accessed by a computer, such as read only memory (ROM), random access memory (RAM), a hard disk drive, a compact disc (CD), a digital video disc (DVD), or any other type of memory. A "non-transitory" computer readable medium excludes wired, wireless, optical, or other communication links that transport transitory electrical or other signals. A non-transitory computer readable medium includes media where data can be permanently stored and media where data can be stored and later overwritten, such as a rewritable optical disc or an erasable memory device.

Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

For a more complete understanding of the present disclosure and its advantages, reference is now made to the following description taken in conjunction with the accompanying drawings, in which like reference numerals represent like parts.

DETAILED DESCRIPTION

Figure 1:
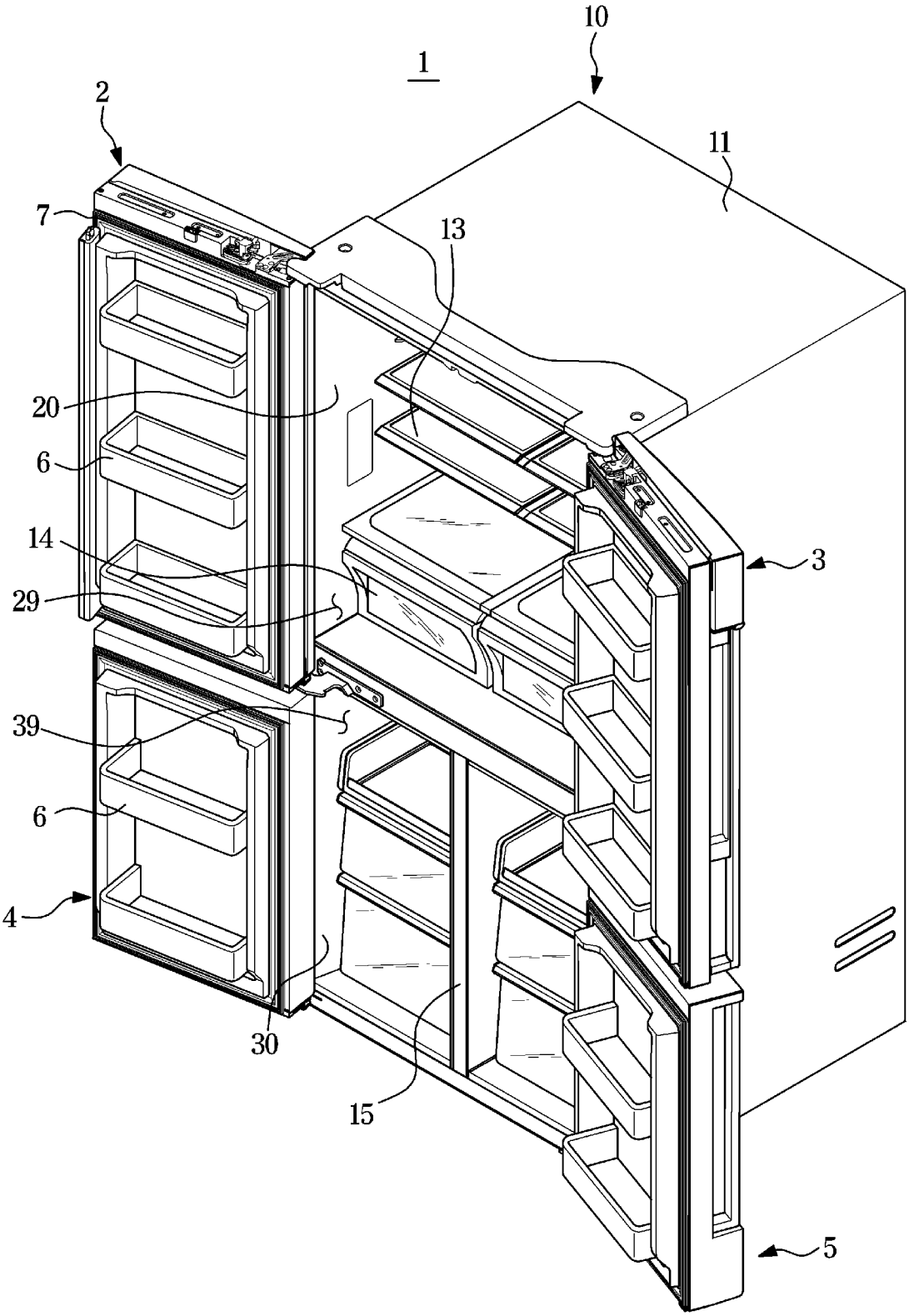
FIG. 1 is a view showing an exterior of a refrigerator according to an embodiment of the present disclosure.

FIGS. 1 through 13, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged system or device.

Embodiments described in the disclosure and configurations shown in the drawings are merely examples of the embodiments of the disclosure and may be used in various different ways at the time of filing of the present application to replace the embodiments and drawings of the disclosure.

The terms used herein are used to describe the embodiments and are not intended to limit and/or restrict the disclosure. The singular forms "a," "an" and "the" are intended to include the plural forms as well, unless the context clearly indicates otherwise. In this disclosure, the terms "including", "having", and the like are used to specify features, figures, steps, operations, elements, components, or combinations thereof, but do not preclude the presence or addition of one or more of the features, figures, steps, operations, elements, components, or combinations thereof.

It will be understood that, although the terms "first", "second", "primary", "secondary", etc., may be used herein to describe various elements, but elements are not limited by these terms. These terms are only used to distinguish one element from another element. For example, without departing from the scope of the disclosure, a first element may be termed as a second element, and a second element may be termed as a first element. The term of "and/or" includes a plurality of combinations of relevant items or any one item among a plurality of relevant items.

Hereinafter, various embodiments according to the present disclosure will be described in detail with reference to the accompanying drawings.

Figure 2:
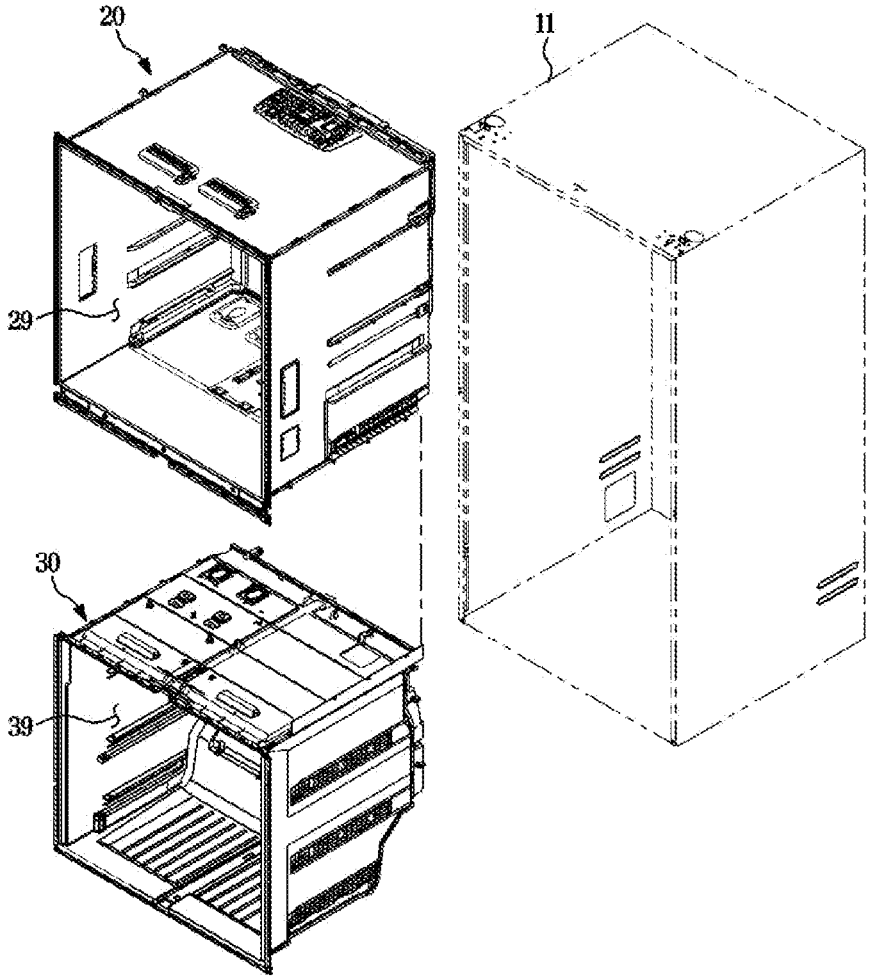
FIG. 2 is an exploded view showing a first inner case, a second inner case, and an outer case of the refrigerator according to an embodiment of the present disclosure.
Figure 3:
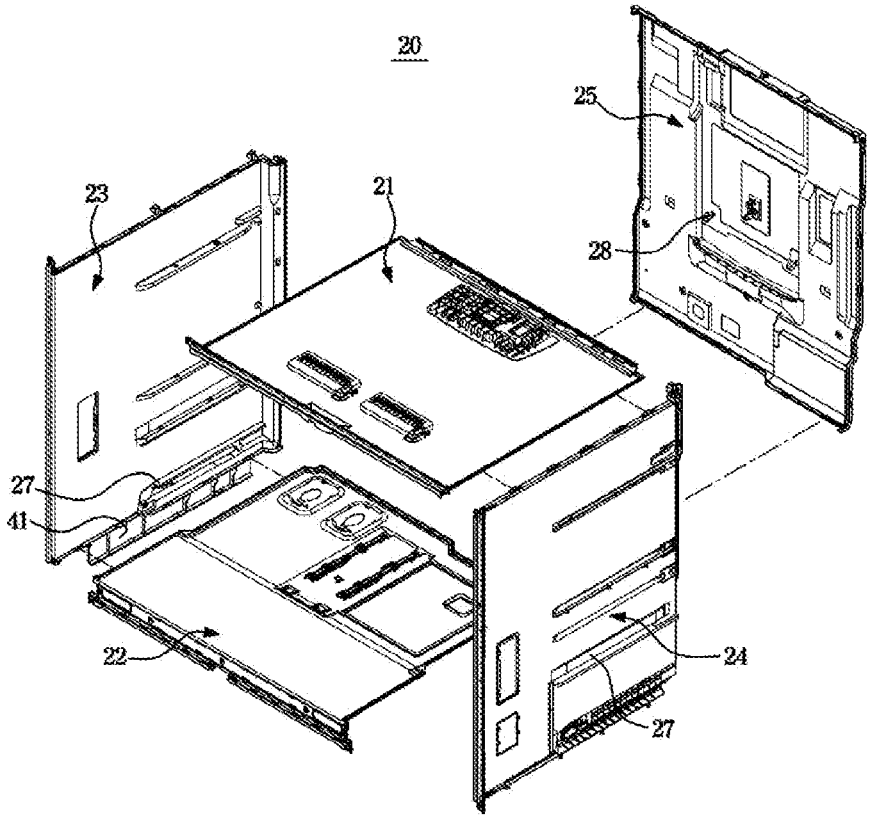
FIG. 3 is an exploded view showing the first inner case according to an embodiment of the present disclosure.
Figure 4:
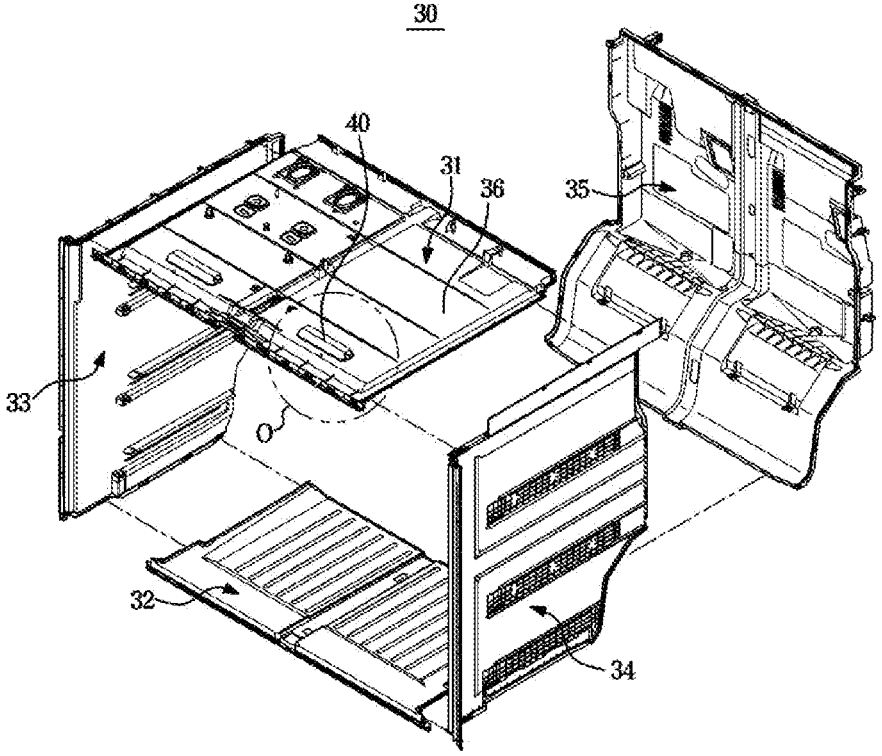
FIG. 4 is an exploded view showing the second inner case according to an embodiment of the present disclosure.

FIG. 1 is a view showing an exterior of a refrigerator according to an embodiment of the present disclosure. FIG. 2 is an exploded view showing a first inner case, a second inner case, and an outer case of the refrigerator according to an embodiment of the present disclosure. FIG. 3 is an exploded view showing the first inner case according to an embodiment of the present disclosure. FIG. 4 is an exploded view showing the second inner case according to an embodiment of the present disclosure.

Referring to FIGS. 1 and 4, a refrigerator 1 may include a main body 10, storage compartments 29 and 39 formed within the main body 10, and doors 2, 3, 4, and 5 that open or close the storage compartments 29 and 39, and a cold air supply device (not shown) that supplies cold air to the storage compartments 29 and 39.

The main body 10 may include inner cases 20 and 30 that form storage compartments 29 and 39, an outer case 11 that is coupled to the outside of the inner cases 20 and 30 to form the exterior thereof, and an insulation 12 (see FIG. 12) provided between the inner cases 20 and 30 and the outer case 11 to insulate the storage compartments 29 and 39.

The cold air supply device may generate cold air using a cooling cycle of compressing, condensing, expanding, and evaporating a refrigerant, and supply the generated cold air to the storage compartments 29 and 39.

The inner cases 20 and 30 may include the first inner case 20 and the second inner case 30. The first inner case 20 and the second inner case 30 may be manufactured separately and then joined together. The first inner case 20 and the second inner case 30 may each have a box shape with an open front.

The first storage compartment 29 may be formed in the first inner case 20, and the second storage compartment 39 may be formed in the second inner case 30. The first storage compartment 29 may be used as a refrigerating compartment and the second storage compartment 39 may be used as a freezing compartment. The second storage compartment 39 may be divided into a plurality of partitions by one or more vertical partition walls 15. The vertical partition 15 may be provided separately from the second inner case 30 and coupled to the second inner case 30. However, the division and use of the storage compartments 29 and 39 as described above is only an example and is not limited thereto.

The first inner case 20 may be located on an upper portion of the main body 10, and the second inner case 30 may be located on a lower portion of the main body 10. However, the positions of the first inner case 20 and the second inner case 30 are not limited to the embodiment, and the first inner case 20 and the second inner case 30 may be arranged in a left-right direction.

A shelf 13 on which food may be placed thereon and a storage container 14 for storing food may be provided within the storage compartments 29 and 39.

The first storage compartment 29 may be opened and closed by the pair of doors 2 and 3. The pair of doors 2 and 3 may be rotatably coupled to the main body 10. The second storage compartment 39 may be opened and closed by the doors 4 and 5, and the doors 4 and 5 may be rotatably coupled to the main body 10. A door shelf 6 for storing food may be provided on a rear surface of the doors 2, 3, 4, and 5. A gasket 7 in close contact with a front surface of the main body 10 may be provided on a rear edge of each of the doors 2, 3, 4, and 5 to seal the storage compartments 29 and 39.

The first inner case 20 may include a plurality of plates 21, 22, 23, 24, and 25. The first inner case 20 may be formed by combining the plurality of plates 21, 22, 23, 24, and 25. The plurality of plates 21, 22, 23, 24, and 25 may be coupled to each other without separate fastening members.

The plurality of plates 21, 22, 23, 24, and 25 may each be formed of a resin material by an injection molding method. Each of the plurality of plates 21, 22, 23, 24, and 25 may have four edges. The plurality of plates 21, 22, 23, 24, and 25 may include the upper plate 21, the lower plate 22, the left plate 23, the right plate 24, and the back plate 25.

The upper plate 21 may form an upper surface of the storage compartment 29. The lower plate 22 may form a lower surface of the storage compartment 29. The left plate 23 may form a left side surface of the storage compartment 29. The right plate 24 may form a right side surface of the storage compartment 29. The back plate 25 may form a back surface of the storage compartment 29.

The shape of the upper plate 21, the lower plate 22, the left plate 23, the right plate 24, and the back plate 25 is not limited to a flat shape without curves, and the upper plate 21, the lower plate 22, the left plate 23, the right plate 24, and the back plate 25 may include curves. It is sufficient for the upper plate 21, the lower plate 22, the left plate 23, the right plate 24, and the back plate 25 to form the upper, lower, left, right, and back surfaces of the storage compartment 29, respectively.

In addition, unlike the present embodiment, at least two adjacent plates among the upper plate 21, the lower plate 22, the left plate 23, the right plate 24, and the back plate 25 may be formed as one piece.

In other words, unlike the present embodiment, the first inner case 20 may be formed from fewer parts instead of five, including the upper plate 21, the lower plate 22, the left plate 23, the right plate 24, and the back plate 25.

For example, the upper plate 21 and the right plate 24 may be injection molded as one piece, and the lower plate 22 and the left plate 23 may be injection molded as one piece. Alternatively, the upper plate 21 and the left plate 23 may be injection molded as one piece, and the lower plate 22 and the right plate 24 may be injection molded as one piece.

As such, although the first inner case 20 may be formed from fewer parts rather than the five parts of the upper plate 21, the lower plate 22, the left plate 23, the right plate 24, and the back plate 25, the contents described below may be equally applicable.

A rail 27 may be formed on the left plate 23 and the right plate 24 to slideably support the storage container 14. A mounting portion 28 for fixing an evaporator may be formed on the back plate 25.

The second inner case 30 may include a plurality of plates 31, 32, 33, 34, and 35. The second inner case 30 may be formed by combining the plurality of plates 31, 32, 33, 34, and 35. The plurality of plates 31, 32, 33, 34, and 35 may be coupled to each other without separate fastening members.

The plurality of plates 31, 32, 33, 34, and 35 may each be formed of a resin material by an injection molding method. Each of the plurality of plates 31, 32, 33, 34, and 35 may have four edges. The plurality of plates 31, 32, 33, 34, and 35 may include the upper plate 31, the lower plate 32, the left plate 33, the right plate 34, and the back plate 35.

The upper plate 31 may form an upper surface of the storage compartment 39. The lower plate 32 may form a lower surface of the storage compartment 39. The left plate 33 may form a left side surface of the storage compartment 39. The right plate 34 may form a right side surface of the storage compartment 39. The back plate 35 may form a back surface of the storage compartment 39.

The shape of the upper plate 31, the lower plate 32, the left plate 33, the right plate 34, and the back plate 35 is not limited to a flat shape without curves, and the upper plate 31, the lower plate 32, and the left plate 33, the right plate 34, and the back plate 35 may include curves. It is sufficient for the upper plate 31, the lower plate 32, the left plate 33, the right plate 34, and the back plate 35 to form the upper, lower, left, right, and back surfaces of the storage compartment 39, respectively.

In addition, unlike the present embodiment, at least two adjacent plates among the upper plate 31, the lower plate 32, the left plate 33, the right plate 34, and the back plate 35 may be formed as one piece.

In other words, unlike the present embodiment, the second inner case 30 may be formed from fewer parts instead of five, including the upper plate 31, the lower plate 32, the left plate 33, the right plate 34, and the back plate 35.

For example, the upper plate 31 and the right plate 34 may be injection molded as one piece, and the lower plate 32 and the left plate 33 may be injection molded as one piece. Alternatively, the upper plate 31 and the left plate 33 may be injection molded as one piece, and the lower plate 32 and the right plate 34 may be injection molded as one piece.

As such, although the second inner case 30 may be formed from fewer parts rather than the five parts of the upper plate 31, the lower plate 32, the left plate 33, the right plate 34, and the back plate 35, the contents described below may be equally applicable.

A mount 40 to which various electrical components are attached may be formed on the upper plate 31. The mount 40 may be formed convexly on an outer surface 36 of the upper plate 31. The mount 40 may be injection molded together with the upper plate 31 during injection molding of the upper plate 31.

However, unlike the embodiment, the mount 40 may be formed on not the upper plate 31, but the lower plate 32, the left plate 33, the right plate 34, and the back plate 35. Alternatively, the mount 40 may be formed on any one plate of the first inner case 20. Accordingly, hereinafter, the upper plate 31 may simply be referred to as the plate 31.

In the following, a structure of the mount 40 and a wire guide that guides a wire connected to electrical component attached to the mount 40 will be described with reference to the accompanying drawings.

Figure 5:
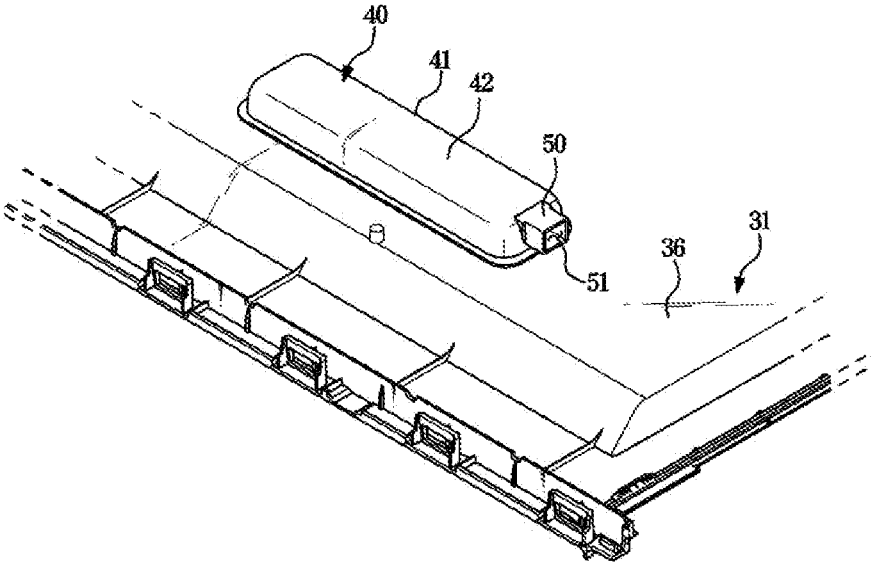
FIG. 5 is an enlarged view of a mount according to an embodiment of the present disclosure, which is an enlarged view of the "0" portion of FIG. 4.
Figure 6:
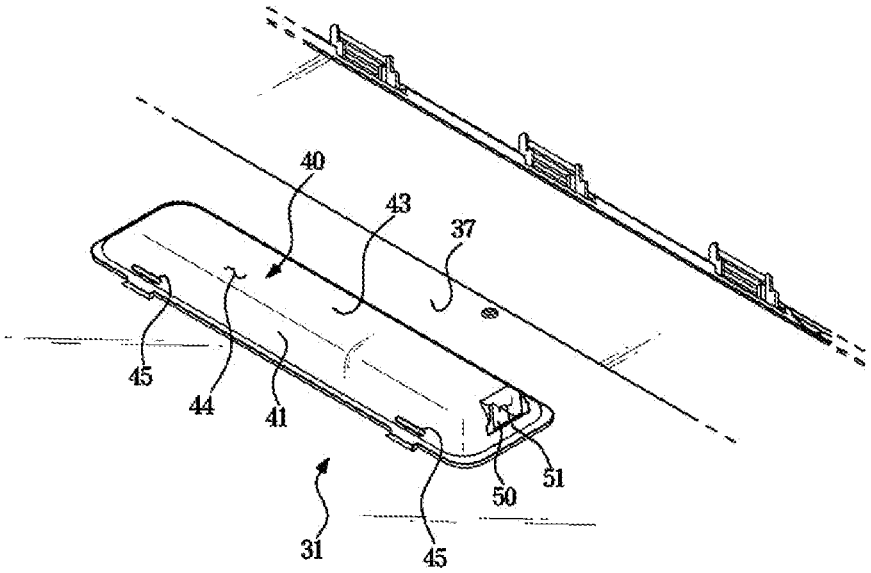
FIG. 6 is a view showing the mount according to an embodiment of the present disclosure as shown from a storage compartment side.
Figure 7:
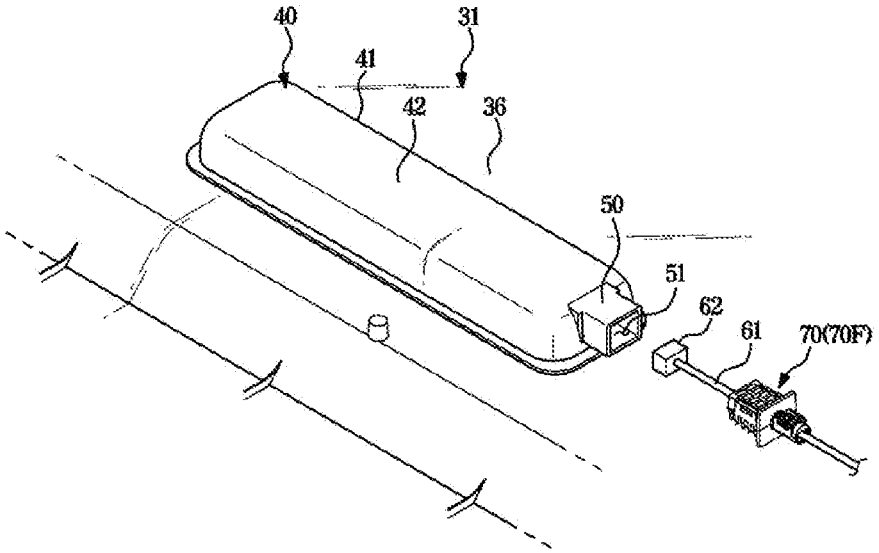
FIG. 7 is a view showing the mount, a connector, a wire, and a wire guide according to an embodiment of the present disclosure.
Figure 8:
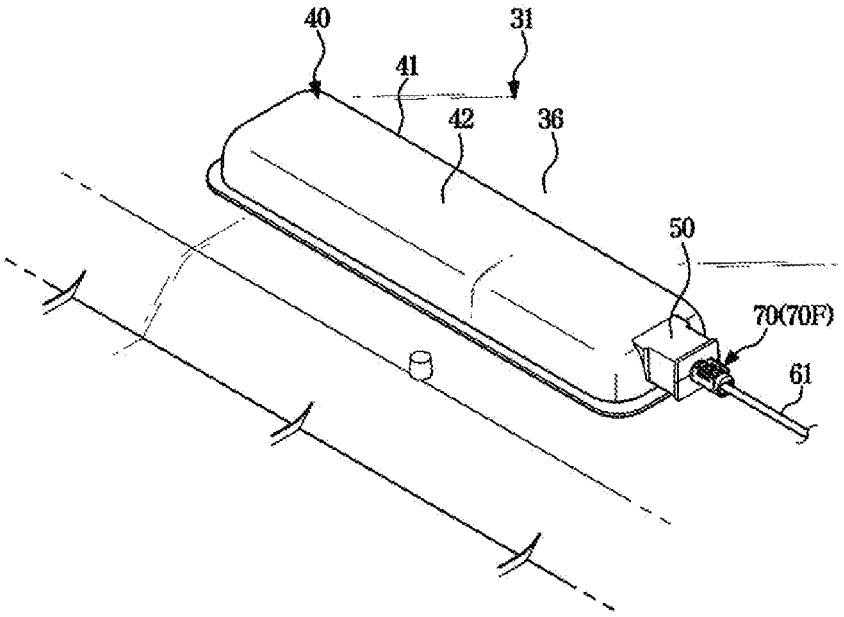
FIG. 8 is a view showing a state in which the wire guide is coupled to the mount according to an embodiment of the present disclosure.

FIG. 5 is an enlarged view of the mount according to an embodiment of the present disclosure, which is an enlarged view of the "O" portion of FIG. 4. FIG. 6 is a view showing the mount according to an embodiment of the present disclosure as shown from the storage compartment side. FIG. 7 is a view showing the mount, a connector, a wire, and a wire guide according to an embodiment of the present disclosure. FIG. 8 is a view showing a state in which the wire guide is coupled to the mount according to an embodiment of the present disclosure.

Referring to FIGS. 5 and 8, any one (e.g., the plate 31) of the plurality of plates of the inner case 30 may include the mount 40 to which an electrical component 68 (see FIG. 12) is attached. The mount 40 may be formed integrally with the plate 31 by injection molding.

The mount 40 may include a mount base 41 which is convex on the outer surface 36 of the plate 31 and recessed on an inner surface 37 of the plate 31.

The mount base 41 may have an outer surface 42 and an inner surface 43. The outer surface 42 of the mount base 41 may be in contact with the insulation 12.

The inner surface 43 of the mount base 41 may form an accommodation space 44 in which the electrical component 68 is accommodated. The accommodation space 44 may be connected to the storage compartment 39. All or some of the electrical component 68 may be accommodated in the accommodation space 44. The electrical component 68 may include various electronic devices that assist in the operation and use of the refrigerator, and may include, for example, lighting devices, sensors, cameras, and the like. Mounting ribs 45 on which the electrical component 68 are mounted may be provided on the inner surface 43 of the mount base 41. The mounting ribs 45 may also be injection molded integrally with the plate 31.

The mount 40 may include a connecting protrusion 50 formed on one side of the mount base 41. The connecting protrusion 50 may be formed to protrude from the mount base 41 toward the insulation 12. The connecting protrusion 50 may protrude from the outer surface 42 of the mount base 41. The connecting protrusion 50 may include a connection hole 51.

The connection hole 51 may connect the accommodation space 44 in the mount 40 and a space outside the mount 40. In other words, the connection hole 51 may connect the inside of the inner case 30 and the outside of the inner case 30. Accordingly, a wire 61 outside the inner case 30 may be inserted into the inner case 30 through the connection hole 51, so that the wire 61 may be connected to the electrical component 68.

The connection hole 51 may be formed to have a square cross-section. However, unlike the embodiment, the connection hole 51 may have a polygonal cross-section other than a square, or may have a circular cross-section.

The wire 61 may pass through the insulation 12 between the inner cases 20 and 30 and the outer case 11 to electrically connect the electrical component 68 to a power supply device (not shown) and a control board (not shown).

An electrical component wire 66 may be connected to the electrical component 68, and an electrical component connector 67 may be coupled to an end of the electrical component wire 66. A connector 62 may be coupled to an end of the wire 61 to be electrically connected to the electrical component connector 67.

The refrigerator may include a wire guide 70 provided to guide the wire 61. The wire guide 70 may guide the wire 61 to pass through the connection hole 51 and be introduced into the inner case 30.

The wire 61 may be mounted on the wire guide 70 so as to pass through the wire guide 70. When the wire 61 is mounted on the wire guide 70 so as to pass through the wire guide 70, the wire 61 may be fixed so as not to move forward or backward with respect to the wire guide 70.

The wire guide 70 may be fitted into the connection hole 51. With the wire 61 mounted on the wire guide 70 such that the wire passes through the wire guide 70, the wire guide 70 may be press-fitted into the connection hole 51. As a result, the wire 61 may be secured against forward or backward movement with respect to the connection hole 51.

The connector 62 may be formed in a size and shape that may pass through the connection hole 51. Accordingly, after the connector 62 first passes through the connection hole 51, the wire guide 70 may be fitted into the connection hole 51.

The wire guide 70 may be provided to be deformable into an unfolded state 70U (see FIG. 9) and a folded state 70F. With the wire guide 70 in the unfolded state 70U, the wire 61 may be inserted into the wire guide 70. When the wire guide 70 is folded in the folded state 70F in which the wire 61 has been inserted into the wire guide 70, the wire 61 may be fixed to the wire guide 70. With the wire guide 70 in the folded state 70F, the wire guide 70 may be inserted into the connection hole 51. The wire guide 70 may be formed by injection molding from a resin material.

Figure 9:
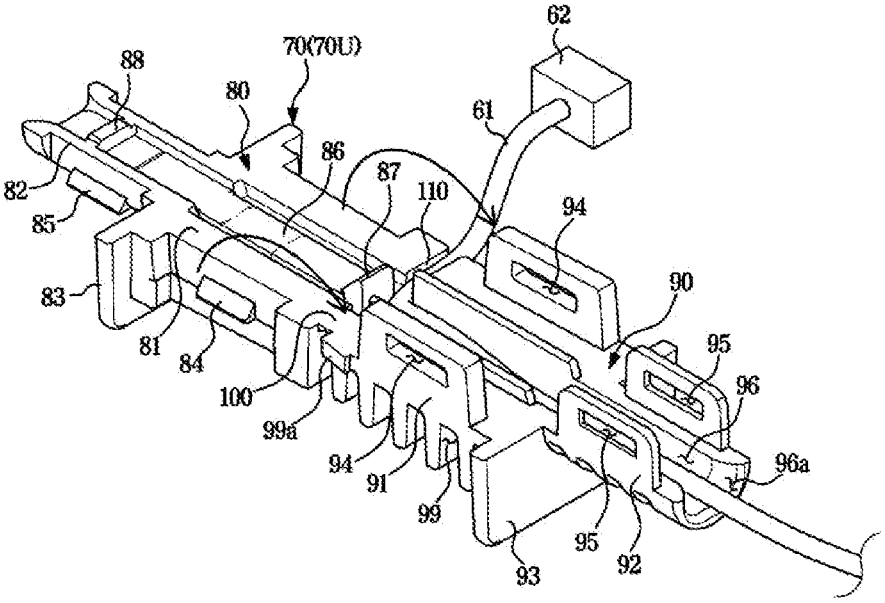
FIG. 9 is a perspective view showing the wire guide in an unfolded state according to an embodiment of the present disclosure.
Figure 10:
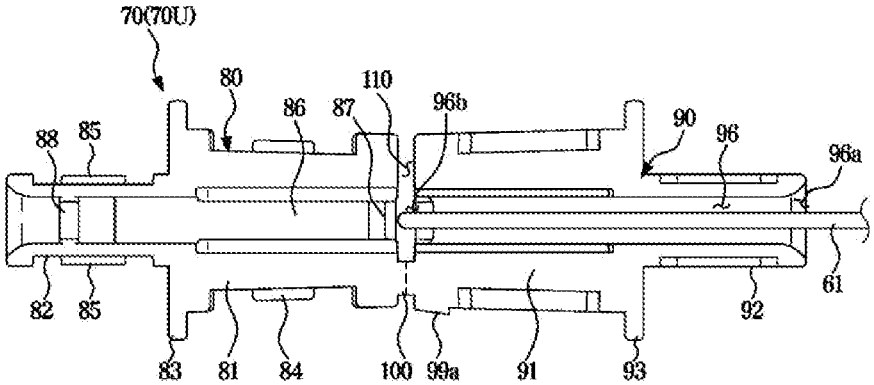
FIG. 10 is a plan view showing the wire guide in the unfolded state according to an embodiment of the present disclosure.
Figure 11:
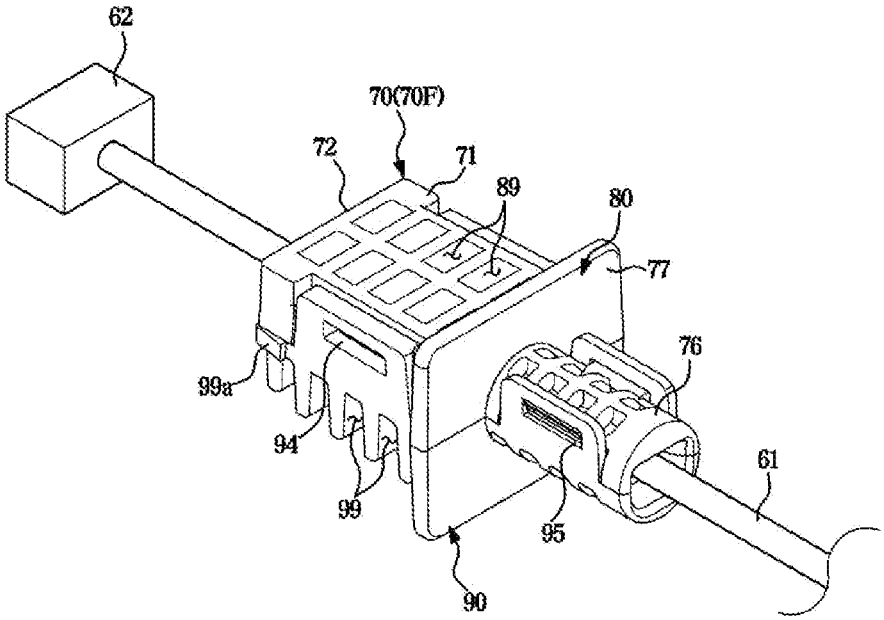
FIG. 11 is a view showing the wire guide in the folded state according to an embodiment of the present disclosure.
Figure 12:
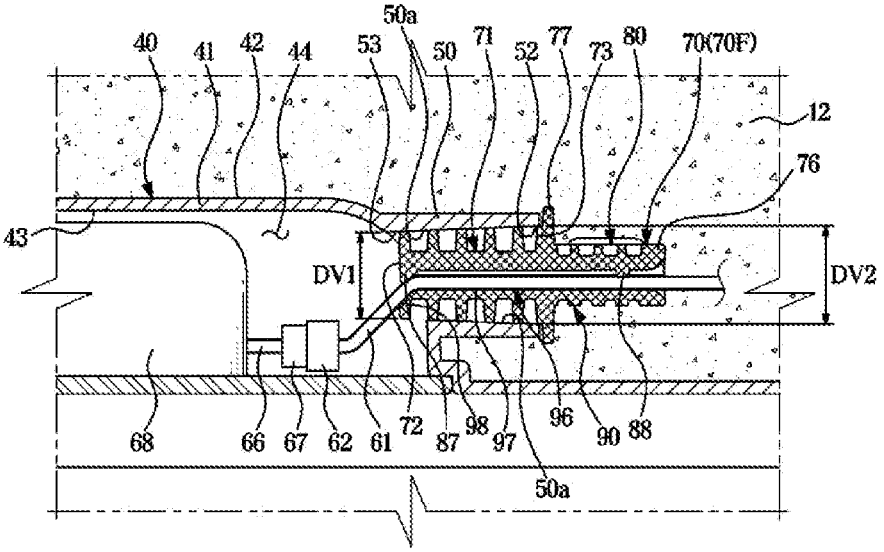
FIG. 12 is a longitudinal cross-sectional view showing the mount and the wire guide according to an embodiment of the present disclosure.
Figure 13:
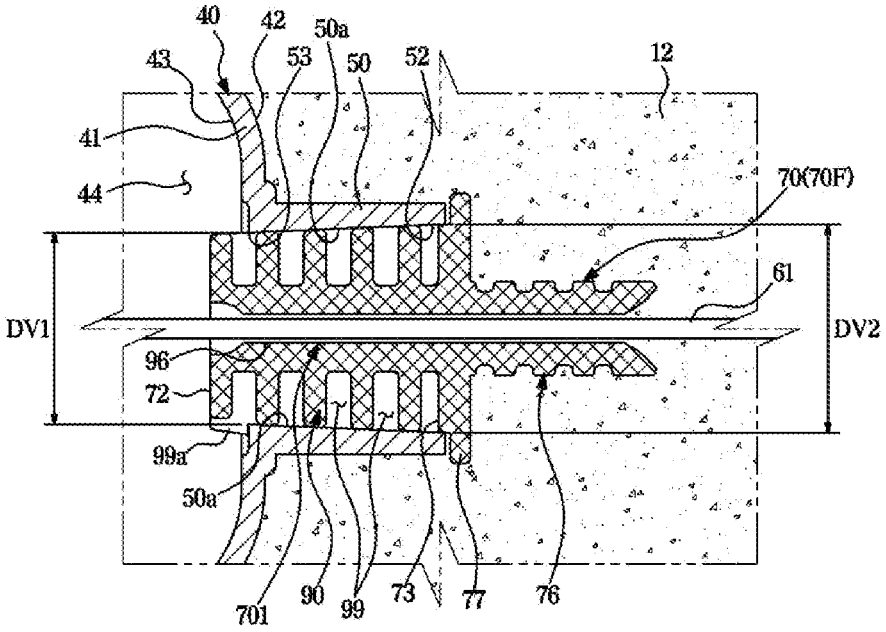
FIG. 13 is a cross-sectional view showing the mount and the wire guide according to an embodiment of the present disclosure.

FIG. 9 is a perspective view showing the wire guide in the unfolded state according to an embodiment of the present disclosure. FIG. 10 is a plan view showing the wire guide in the unfolded state according to an embodiment of the present disclosure. FIG. 11 is a view showing the wire guide in the folded state according to an embodiment of the present disclosure. FIG. 12 is a longitudinal cross-sectional view showing the mount and the wire guide according to an embodiment of the present disclosure. FIG. 13 is a cross-sectional view showing the mount and the wire guide according to an embodiment of the present disclosure.

With reference to FIGS. 9 to 13, a structure of the wire guide 70 according to an embodiment of the present disclosure will be described in detail.

When the wire guide 70 is inserted into the connection hole 51, the wire guide 70 may be supported and fixed by contacting an inner surface 50*a* of the connecting protrusion 50. Accordingly, when the wire guide 70 is inserted into the connection hole 51, the wire guide 70 may seal the connection hole 51 to prevent foaming liquid of the insulation from entering the inside of the inner case 30 through the connection hole 51.

When the wire guide 70 is in the folded state 70F, the wire guide 70 may include an insertion portion 71 that may be inserted into the connection hole 51, and a handle portion 76 that protrudes toward the insulation 12 in a state in which the insertion portion 71 has been inserted into the connection hole 51. The insertion portion 71 may form a leading section of the wire guide 70, and the handle portion 76 may form a trailing section of the wire guide 70. The insertion portion 71 may be formed to have a larger cross-section than the handle portion 76.

At least a portion of the insertion portion 71 may be inserted into the connection hole 51. The handle portion 76 may be provided to be grasped by the user to move the wire guide 70. A stopper 77 capable of limiting the insertion depth of the wire guide 70 may be provided between the insertion portion 71 and the handle portion 76. The stopper 77 may have a larger size than the connection hole 51 to prevent the stopper from passing through the connection hole 51.

The insertion portion 71 may be formed to have a square cross-section to correspond to the shape of the connection hole 51. The insertion portion 71 may be formed such that the size of the cross-sectional increases from a front end 72 to a rear end 73.

In other words, a vertical thickness DV2 at the rear end 73 of the insertion portion 71 may be greater than a vertical thickness DV1 at the front end 72 of the insertion portion 71, and thus the vertical thickness may progressively increase from the front end 72 to the rear end 73 of the insertion portion 71.

Furthermore, a horizontal thickness DH2 at the rear end 73 of the insertion portion 71 may be greater than a horizontal thickness DH1 at the front end 72 of the insertion portion 71, and thus the horizontal thickness may progressively increase from the front end 72 to the rear end 73 of the insertion portion 71.

Correspondingly, the connection hole 51 may be formed such that the horizontal thickness and vertical thickness gradually decrease from an entry 52 to an exit 53 of the connection hole 51.

As a result, in the process of inserting the insertion portion 71 into the connection hole 51, the insertion portion 71 may be smoothly inserted into the connection hole 51, and after the insertion portion 71 is inserted into the connection hole 51, the insertion portion 71 and the inner surface 50*a* of the connecting protrusion 50 may be brought into close contact without forming a gap.

The wire guide 70 may be provided to be deformable between the unfolded state 70U and the folded state 70F. To this end, the wire guide 70 may include a first part 80, a second part 90, and a hinge portion 100. The hinge portion 100 may connect the first part 80 and the second part 90 and be the center of unfolding and folding motion of the first part 80 and the second part 90.

In the unfolded state 70U, the first part 80 and the second part 90 may be unfolded to be located on the same plane, and in the folded state 70F, the first part 80 and the second part 90 may be rotated 180 degrees to enclose each other.

The hinge portion 100 may be formed to connect one side of the first part 80 and one side of the second part 90 facing the one side of the first part 80. The other side of the first part 80 and the other side of the second part 90 may be spaced apart from each other, and a wire holding hole 110 may be formed therebetween. As such, the wire holding hole 110 is pierced in the wire guide 70, so that the wire 61 may be easily held in a wire passage 96 through the wire holding hole 110.

The first part 80 and the second part 90 may be nested together to form the insertion portion 71, the handle portion 76, and the stopper 77. To this end, the first part 80 may include a first insertion 81, a first handle 82, and a first stopper 83, and the second part 90 may include a second insertion 91, a second handle 92, and a second stopper 93. The first insertion 81 and the second insertion 91 may be arranged to face each other and may be connected to each other by the hinge 100.

With the wire guide 70 in the folded state 70F, the first insertion 81 and the second insertion 91 may form the insertion 71, the first handle 82 and the second handle 92 may form the handle 76, and the first stopper 83 and the second stopper 93 may form the stopper 77.

The first part 80 and the second part 90 may be coupled to each other to prevent the wire guide 70 from unfolding when the wire guide 70 is in the folded state 70F. To this end, the first part 80 may include first couplings 84 and 85, and the second part 90 may include second couplings 94 and 95 coupled to the first couplings 84 and 85. The first couplings 84 and 85 may be formed as locking protrusions, and the second couplings 94 and 95 may be formed as locked holes formed to be locked by the locking protrusions. However, the locking structure of the first couplings 84 and 85 and the second couplings 94 and 95 is not limited thereto. The second couplings 94 and 95 may be formed in the shape of a locking groove or protrusion, or the first couplings 84 and 85 and the second couplings 94 and 95 may be formed in opposite shapes to each other.

The first couplings 84 and 85 may include the first coupling 84 formed on opposite sides of the first insertion 81 and the first coupling 85 formed on opposite sides of the first handle 82. The second couplings 94 and 95 may include the second coupling 94 formed on opposite sides of the second insertion 91 and the second coupling 95 formed on opposite sides of the second handle 92.

The second part 90 may include the wire passage 96 through which the wire 61 passes. The wire passage 96 may be formed in a groove shape to be recessed in one surface of the second part 90. The one surface of the second part 90 on which the wire passage 96 is formed may face the first part 80 when the wire guide 70 is in the folded state 70F.

Accordingly, in the unfolded state 70U, the wire passage 96 may be opened to allow the wire 61 to be mounted. The wire passage 96 may include an inlet 96*a* and an outlet 96*b*. The inlet 96*a* and the outlet 96*b* may be formed at an end of the second handle 92 and an end of the second insertion 91, respectively.

As such, as the wire passage 96 is formed to be recessed on one side of the second part 90, it may be easy to rotate the first part 80 while retaining the second part 90 when folding the wire guide 70 from the unfolded state 70U to the folded state 70F.

The first part 80 may include a cover 86 provided to cover an open one surface of the wire passage 96 when the wire guide 70 is in the folded state 70F. The first part 80 may include pressing protrusions 87 and 88 that press the wire 61 mounted on the wire passage 96 when the wire guide 70 is the folded state 70F. The pressing protrusions 87 and 88 may protrude from the cover 86. The pressing protrusions 87 and 88 may include the pressing protrusion 87 formed on the first insertion 81 and the pressing protrusion 88 formed on the first handle 82.

In the folded state 70F of the wire guide 70, the pressing protrusions 87 and 88 press the wire 61 against an inner surface of the wire passage 96, so that the wire 61 may be clamped between the pressing protrusions 87 and 88 and the inner surface of the wire passage 96 and fixed thereto.

The wire passage 96 may be bendable to prevent the wire 61 from moving forward and backward. In other words, the second part 90 may include a straight portion 97 forming a portion of the wire passage 96, and a curved portion 98 forming another portion of the wire passage 96 and extending angularly from the straight portion 97. The wire passage 96 formed to be bendable may allow the wire 61 to be deformed to be curved, and thus the wire 61, thereby further preventing the wire 61 from moving forward and backward with respect to the wire guide 70. The pressing protrusion 87 of the first part 80 may press on the wire 61 located at the curved portion 98 to the wire 61 to be bent.

The first part 80 may include leak-proof grooves 99 and the second part 90 may include leak-proof grooves 99 so as to further prevent the foaming liquid of the insulation 12 from entering the interior of the inner case 30 through the connection hole 51.

The leak-proof grooves 99 may be formed on an outer surface of the first insertion 81 so that the foaming liquid penetrating between the outer surface of the first insertion 81 and the inner surface 50*a* of the connecting protrusion 50 may be trapped in the leak-proof grooves 99. The leak-proof grooves 99 may be formed in a plurality so as to be spaced apart from each other in the first insertion 81.

The leak-proof grooves 99 may be formed on an outer surface of the second insertion 91 so that the foaming liquid penetrating between the outer surface of the second insertion 91 and the inner surface 50*a* of the connecting protrusion 50 may be trapped in the leak-proof grooves 99. The leak-proof grooves 99 may be formed in a plurality so as to be spaced apart from each other.

The wire guide 70 may include an anti-separation protrusion 99*a* that prevents the wire guide 70 from being separated from the connection hole 51 after the wire guide 70 is coupled to the connection hole 51. The anti-separation protrusion 99*a* may be formed on one end of the second insertion 91. However, in contrast to the embodiment, the anti-separation protrusion 99*a* may be formed on the first insertion 81, or may be formed on both the first insertion 81 and the second insertion 91. The anti-separation protrusion 99*a* may pass through the connection hole 51 to be caught on the inner surface 43 of the mount base 41 when the wire guide 70 is inserted into the connection hole 51.

The inner case and the wire guide structure of the embodiments described above may be applied to a number of different home appliances, including not only refrigerators, but also clothes treating apparatuses, shoe treating apparatuses, cooking apparatuses, dishwashers, air conditioners, and the like.

That is, a home appliance may include a main body having an interior space open on one side to perform a given function, and a door coupled to the main body to open or close the open one side of the interior space. The main body of the home appliance may include an inner case, an outer case, and an insulation disposed between the inner case and the outer case, and the inner case of the main body of the home appliance may be adapted with the structure of the inner case and the wire guide of the embodiments described above.

While the present disclosure has been particularly described with reference to exemplary embodiments, it should be understood by those of skilled in the art that various changes in form and details may be made without departing from the spirit and scope of the present disclosure.

Although the present disclosure has been described with various embodiments, various changes and modifications may be suggested to one skilled in the art. It is intended that the present disclosure encompass such changes and modifications as fall within the scope of the appended claims.

What is claimed is:

1. A refrigerator, comprising:

an inner case forming a storage compartment, the inner case including a mount with a connecting protrusion in which a connection hole is formed;

an outer case coupled to an outside of the inner case;

an insulation provided between the inner case and the outer case;

an electrical component attached to the mount;

a wire electrically connected to the electrical component through the connection hole;

a wire guide fitted into the connection hole to guide the wire;

a first connector coupled to an end of the wire; and a second connector electrically connected to the electrical component, wherein the mount includes an accommodation space to accommodate the electrical component, and the first connector is electrically connectable to the second connector in the accommodation space.

2. The refrigerator of claim 1, wherein the wire guide comprises:

an insertion portion formed on a leading section of the wire guide and inserted into the connection hole, a handle portion formed on a trailing section of the wire guide, and a stopper portion formed between the insertion portion and the handle portion.

3. The refrigerator of claim 2, wherein the insertion portion is formed such that a horizontal thickness and a vertical thickness thereof progressively increase from a front end to a rear end of the insertion portion.

4. The refrigerator of claim 3, wherein the connection hole is formed such that a horizontal thickness and a vertical thickness thereof progressively decrease from an entry to an exit of the connection hole.

5. The refrigerator of claim 2, wherein the insertion portion includes a plurality of leak-proof grooves formed on an outer surface of the insertion portion to prevent foaming liquid of the insulation from entering through the connection hole.

6. The refrigerator of claim 2, wherein the insertion portion includes an anti-separation protrusion protruding from an outer surface of the insertion portion to prevent the wire guide from being separated from the connection hole after the wire guide is coupled to the connection hole.

7. The refrigerator of claim 1, wherein the wire guide includes:

a wire passage formed in the wire guide to allow the wire to pass through, and a pressing protrusion pressing the wire to allow the wire to be fixed to the wire passage.

8. The refrigerator of claim 7, wherein the wire passage is bendable and the wire is fixed to the wire passage.

9. The refrigerator of claim 7, wherein the wire guide is deformable between an unfolded state and a folded state.

10. The refrigerator of claim 9, wherein the wire guide comprises:

a first part, a second part, and a hinge portion connecting the first part and the second part, and being a center of unfolding and folding motion of the first part and the second part.

11. The refrigerator of claim 10, wherein:

the first part includes a first coupling, the second part includes a second coupling, and the first coupling and the second coupling are coupled to prevent the wire guide from unfolding when the wire guide is in the folded state.

12. The refrigerator of claim 10, wherein:

the wire passage is formed to be recessed in one surface of the second part, and the first part includes a cover portion formed to cover the wire passage when the wire guide is in the folded state.

13. The refrigerator of claim 12, wherein the pressing protrusion protrudes from the cover portion.

14. The refrigerator of claim 10, wherein:

the hinge portion is configured to connect one side of the first part and one side of the second part facing the one side of the first part, and the wire guide includes a wire holding hole formed between another side of the first part and another side of the second part to hold the wire in the wire passage.

15. A refrigerator comprising:

an inner case forming a storage compartment, the inner case including a mount with a connecting protrusion in which a connection hole is formed, an outer case coupled to an outside of the inner case, an insulation provided between the inner case and the outer case, an electrical component attached to an interior of the inner case, a wire electrically connected to the electrical component through the connection hole formed in the inner case, and a wire guide fixing the wire and connecting the connection hole to seal the connection hole, the wire guide being deformable between an unfolded state and a folded state, a first connector coupled to an end of the wire, and a second connector electrically connected to the electrical component, wherein the mount includes an accommodation space to accommodate the electrical component, and the first connector is electrically connectable to the second connector in the accommodation space, wherein the wire guide includes:

a first part, a second part, and a hinge portion connecting the first part and the second part and being a center of unfolding and folding motion of the first part and the second part.

16. The refrigerator of claim 15, wherein:

the second part includes a wire passage formed to be recessed to allow the wire to pass through, and the wire is mounted on the wire passage in the unfolded state.

17. The refrigerator of claim 15, wherein the wire guide is configured to be changed from the unfolded state to the folded state when the wire is mounted in a wire passage.

18. The refrigerator of claim 15, wherein the first part includes a pressing protrusion to press the wire so that the wire is mounted in a wire passage and is fixed when the wire guide is in the folded state.

19. The refrigerator of claim 15, wherein the first part includes a first coupling, and the second part includes a second coupling, and the first coupling and the first second coupling are configured to be coupled to prevent the wire guide from unfolding when the wire guide has been in the folded state.

* * * * *